United States Patent [19]

Johnson

[11] Patent Number: 4,958,814

[45] Date of Patent: Sep. 25, 1990

[54] INTERVAL LOCATOR

[76] Inventor: Brian A. Johnson, 519 Green St., Perry, Mich. 48872

[21] Appl. No.: 420,889

[22] Filed: Oct. 13, 1989

[51] Int. Cl.[5] ..... B25B 3/00; E04G 21/18; G01C 5/00

[52] U.S. Cl. ..... 269/43; 269/900; 269/904; 269/909; 269/910; 264/261; 248/216.1; 52/127.2; 52/749; 52/750; 33/613

[58] Field of Search ..... 52/127.2, 749, 750; 33/605, 613, 527, 526, 197, 194, 562; 248/216.1, 546; 269/43, 900, 901, 902, 903, 904, 905, 906, 909, 910, 289; 264/261

[56] References Cited

U.S. PATENT DOCUMENTS

| | | | |
|---|---|---|---|
| 872,087 | 11/1907 | Schwensow | 33/194 X |
| 1,665,400 | 4/1928 | Bittner | 33/194 |
| 2,557,586 | 9/1951 | Werder | 269/904 X |
| 2,686,959 | 8/1954 | Robinson | 269/43 X |
| 2,729,895 | 1/1956 | Backstrom | 33/197 |
| 2,927,347 | 3/1960 | Kohler | 29/462 X |
| 3,197,874 | 8/1965 | Fox | 33/194 |
| 3,201,874 | 8/1965 | Christy | 33/194 X |
| 3,874,625 | 4/1975 | Hansen | 248/357 X |
| 3,959,945 | 6/1976 | Allen | 52/127.2 X |
| 4,079,496 | 3/1978 | Schmidt | 29/241 X |
| 4,322,064 | 3/1982 | Jarvis | 269/904 X |
| 4,843,726 | 7/1989 | Ward | 52/127.2 |

FOREIGN PATENT DOCUMENTS

| | | | |
|---|---|---|---|
| 511501 | 8/1955 | Canada | 52/696 |
| 14517 | 6/1910 | United Kingdom | 269/43 |

*Primary Examiner*—Carl D. Friedman
*Assistant Examiner*—D. Ripley
*Attorney, Agent, or Firm*—Miller, Morriss & Pappas

[57] ABSTRACT

A substantially integral one-piece interval locator in flat relatively thin elongate material and having two or more interval spaced notches for locating building components on selected interval positions and including hardened punch points locating and holding the centers of structural members with high precision and repetitive accuracy. The structure includes hand grip means and tapered ends.

5 Claims, 1 Drawing Sheet

INTERVAL LOCATOR

The present invention is a simple and substantially structure which defines, with precision, the interval as for example between centers of common building components such as studs, joists, trusses, and other components as regularly located on center intervals.

In the construction and framing of buildings particular intervals as between adjacent parts must be located and the elements must be held to those intervals through their entire length and they must be held in place so that they can be nailed, bolted, welded or otherwise fixed by the carpenters or construction workers. In a general observation, substantial time is consumed in establishing the location, checking the alignment over the total length and in the matter of fixing the structural element in place and on proper centers. Usually two workmen are required and in some instances several more where, for example, trusses are set and must be swung into position as by cranes or hoists and then jockeyed and located in place. The matter of establishing the centers for location is a part of the time consumption.

Observing these difficulties encountered in the building trades, the present invention seeks to advance the art and facilitate the erection of building components by the provision of a substantially integral interval locator device in light weight, sturdy, flat, thin section materials which includes hand grip means, interval notches, punch points at notch centers with straight leading and trailing edges and with relatively tapered ends.

This unit construction allows the user to repetitively locate plural interval centers in one usage and to impale or mark the center of interval points during manipulation of the building components as studs, trusses, joists and the like.

The device extends the reach of the user to grab, manipulate and position building components as they are man-handled or hoisted toward the use situs.

Accordingly the principal object of the present invention is to improve the handling and positioning of building components in proper and parallel registry by the provision of an interval locator that is durable and easy to use.

Other objects in providing a lightweight locator, with comfortable feel, durability and in avoidance of complex construction will be appreciated as the description process to define a preferred embodiment of the new, useful and unobvious interval locator.

GENERAL DESCRIPTION

In general, the interval locator of the present invention is an elongate relatively flat and thin section rigid integral planar plate with two or more notches on one of the elongate edges, and the notches occurring at regular intervals. Each of the notches at the centers thereof defines a locating interval that is repetitive as is found in the framing of the buildings, homes and the like. The interval between centers is functionally secured by hardened punch points which extend in the plane of the plate from the base of the notches and the centers of the notches. Hand openings are provided which are ovoid in preferred form in easy spacing relation to allow firm comfortable manipulation by the user. The preferred plate, as shown, includes adequate clear space for including measuring (dimensioned) portions along the straight-edged notch face and including space for instructional marking delineating the frequency of interval between notch centers as 16", 18", 20", 24" and the like and including metric or other measures. While only two notches are illustrated, the interval locator may be extended using any particular interval scheme so that the utility is extendable. In general, testing to date indicates a preference for a single interval system on any particular interval locator. Workers can select the interval unit to match the requirements of the job.

In the Drawings

SPECIFIC DESCRIPTION

Figure 1:
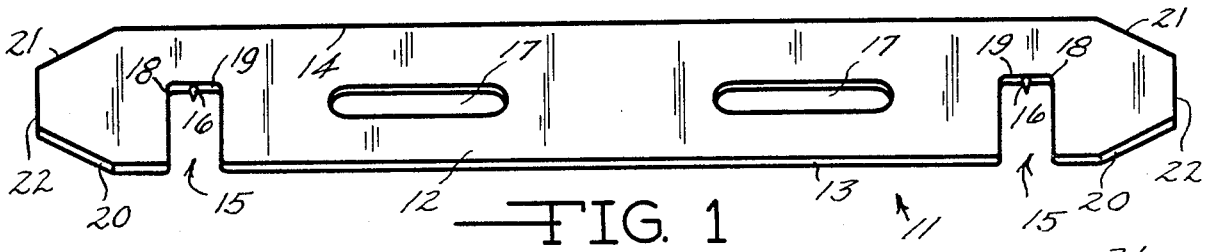
FIG. 1 is a perspective view of an interval locator in accord with the present invention looking at the forward notched edge tilted downwardly to illuminate the preferred hardened punch points projecting from the bases of the notches midway of the base of each notch and in the plane of the thickness of the interval locator.
Figure 2:
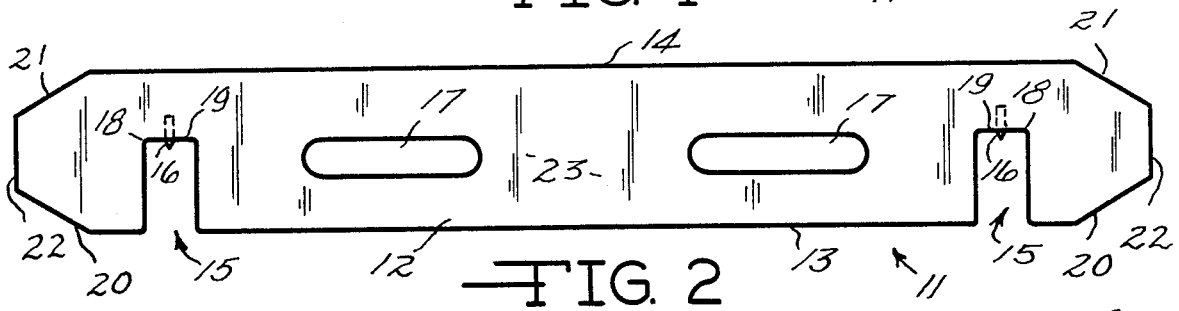
FIG. 2 is a top plan view of an interval locator in accord with the present invention as seen in FIG. 1.
Figure 3:
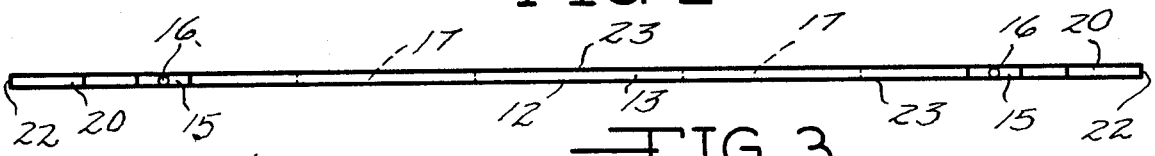
FIG. 3 is a frontal edge elevation view in which the notches and tapered ends are indicated as well as the notch-centered punch points. The hand-grips (through openings) are located and shown in phantom line.

Referring to the drawing and to FIG. 1 thereof, the interval locator 11 is shown as an elongate relatively flat, thin and rigid integral planar plate 12 having a frontal longitudinal edge 13 and a rear longitudinal edge 14. The plate 12 and the leading or frontal edge 13 thereof includes two or more notches 15. The notches 15 centered at a regular repeated locator interval, as for example 24 inches center to center. The centers of each notch are defined by punch points 16 and the punch points are sharp, tapered and hardened projecting into the plane of the plate 12. In the preferred embodiment they are sharpened steel pins driven and secured by the stock of plate 12 in the positions shown. The notches 15 define an opening which slightly exceeds the thickness of building components to be acted upon by the interval locators of the present invention. In the instance of 2 inch (nominal) stock, for example, in wood, the notch openings would exceed the thickness of the stock by 1/16 inch. This excess of width assists in handling the building components when the worker reaches out and captures the stud or truss, for example, in one of the notches 15. The depth of the notches 15 would be about 2-⅝ inches. Hand grips such as the ovoid elongate openings 17 are comfortably sized and located and are defined through the plates 17 at convenient handling positions. The edges of all penetrations as notches 15, and hand grips 17 as well as all external surfaces are comfortably rounded so as to not cut or abrade the hands of the users and to avoid damage to the interval locator tool when it contacts stock or surfaces exceeding the hardness of the material of plate 12. The fillets 18 at the corners of the bases 19 of the notches 15 allow the extension of the punch points 16 to engage the stock of the building components and center the building components upon insertion in the notches 15. The FIGS. 1, 2 and 3 express the simplicity of the substantially integral construction of the interval locator 11.

Figure 4:
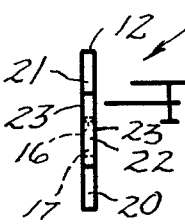
FIG. 4 is an end elevational view of the structure of FIGS. 1, 2 and 3 and indicating the chamfer-cuts which taper the ends of the interval locator.

In the FIG. 4, the truncations 20 and 21 at the tapered ends 22 of the elongate plate 12 are visible and the relative thickness of the plate 12 is best appreciated.

The simplicity of the construction is easily appreciated and in addition the surface area on both upper and lower surface 23 of the plate 12 provides an excellent surface for imprintation of operating instructions and measurement indicia, especially along the front and rear edges 13 and 14. This surface may also receive identifying marking as, for example, identity of the interval to be located and other trade-useful adaptation. Typically, level bubbles (not shown) may be mounted thereon as well as wall mounting openings and the like which are well known in the trades but comprise no inventive portion of the present invention.

The preferred embodiment illustrated is made from aluminum or a light weight alloy of aluminum but may be made from a light weight plastic or resin material having good dimensional stability, rigidity and light weight. It is easily sheared from flat stock and may be fashioned by sawing or other well known machinery operations. Imprintation may be stamped or cast in the flat surfaces or affixed thereto in the form of decals or rubbings into recesses engraved, embossed or otherwise provided. Generally the selection of material is dictated by durability and economy.

Figure 5:
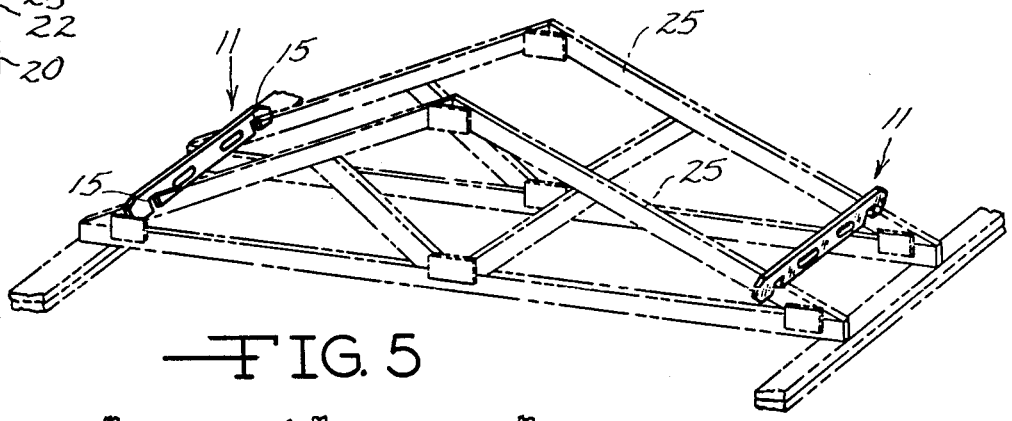
FIG. 5 is a perspective view, somewhat exaggerated and showing a pair of interval locators in use establishing a precision accurate location of a pair of truss elements, the latter shown in phantom-line.
Figure 6:
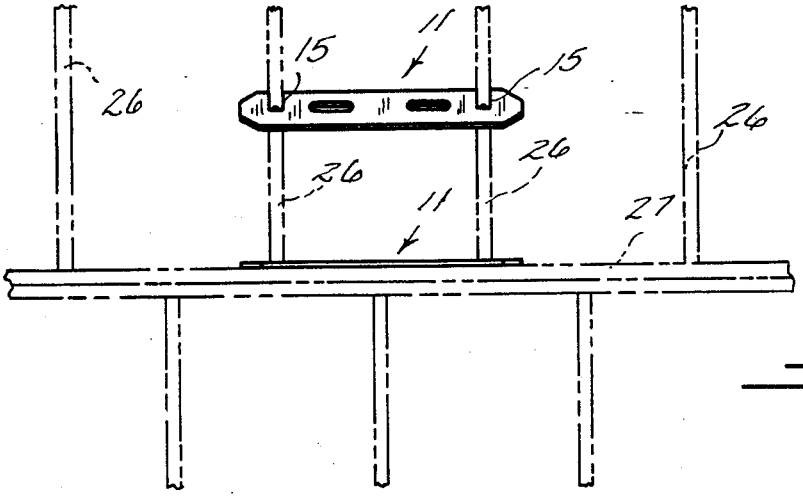
FIG. 6 is also a perspective view of the interval locators of the present invention, one shown at the base of a building component and locating the next adjacent building component captured at two elevations to assure parallelity and register at a selected interval.

The utility of the interval locator 11 is best understood by reference to the FIGS. 5 and 6 showing the positioning of the interval locator 11 in respect to building components as trusses 25 or studs and joists 26 shown in phantom line. The interval locators 11 in FIG. 5 are swung into position from a crane or hoist and after location of the first truss 25 the subsequent trusses 25 are located in the notch intervals as previously described and the centers located by the hardened punch points. The interval locators 11 retain the interval while nailing or fastening progresses and the interval locators working from both ends of the truss assure the selected interval over the whole length of the trusses 25, studs or joists and to connection with the ridge elements or stringers. In FIG. 6 viewing the building components as studs or floor joists 26 the interval locators 11 working at the selected interval of the notches on the plates provide an established interval on the plates or beams 27 and repeat the interval by moving upward and by fixing the next adjacent stud 26 in place. The accuracy is unusually correct and uniform and the speed of erection is materially improved. The locators 11, as described, extend the effective reach of the workers expediting the handling of the building components.

Having thus described a preferred embodiment of the present invention those ordinarily skilled in the art of design and manufacture as well as use of such tools will immediately appreciate the very significant advance embodied therein and may devise or suggest improvements, modifications and changes. Such improvements, modifications and changes are intended to be included in the scope of the present invention limited only by the scope of the hereinafter appended claims.

I claim:

1. An interval locator for building components comprising: an elongate, relatively flat, thin and rigid integral planar plate and two or more notches further comprising a base; said notches being on one of the elongate edges of said plate in relatively regular intervals each of said notches having a hardened punch point extending from the base and centered on said base of each of said notches in a planar attitude with said plate; and at least one integral opening through said plate defining a hand grip means; and said punch points defining interval center location points for adjacent building components.

2. In an interval locator as defined in claim 1 wherein said planar plate is a light weight metal and said punch points have sharp elongate tapered and hardened tips.

3. An interval locator in accord with claim 2 in which said interval hand grip means is at least one ovoid opening through said plate.

4. An interval locator for building components comprising:

an elongate, flat, rigid and durable plate further comprising with longitudinal edges plural notches in regular spaced intervals along one of the longitudinal edges of said plate; a said notches having a base defining a plane with hardened punch points centered on said base; said hardened punch points extending into the plane or said notches from the base portion of said notches; said punch points accurately defining regular intervals as between the centers of adjacent notches; said plate having tapered ends in facilitation of manipulating building components; and at least one through orifice in said plate defining hand grip means inset from said elongate edge of said plate opposite said notched edge of said plate.

5. In the combination of claim 4 wherein said flat durable plate includes space and surfaces to accommodate clear printing of interval designation and measurement indicia.

* * * * *

UNITED STATES PATENT AND TRADEMARK OFFICE

CERTIFICATE OF CORRECTION

PATENT NO. : 4,958,814

DATED : Sep. 25, 1990

INVENTOR(S) : Brian A. Johnson

It is certified that error appears in the above—identified patent and that said Letters Patent is hereby corrected as shown below:

Column 1, line 5, before "structure" insert --integral--.

Column 4, line 18 after "intervals" insert a "semicolon" ---;---

Column 4, line 34 after "plate" insert ---with longitudinal edges---.

Column 4, line 35 after "prising" delete ---with longitudinal edges---.

Signed and Sealed this

Thirty-first Day of December, 1991

*Attest:*

HARRY F. MANBECK, JR.

*Attesting Officer*

*Commissioner of Patents and Trademarks*